US005211226A

United States Patent [19]

Hendrickson et al.

[11] Patent Number: 5,211,226

[45] Date of Patent: May 18, 1993

[54] METAL-TO-METAL SEAL FOR OIL WELL TUBING STRING

[75] Inventors: James D. Hendrickson, Carrollton; William D. Henderson, League City; John C. Gano, Carrollton, all of Tex.

[73] Assignee: Otis Engineering Corporation, Carrollton, Tex.

[21] Appl. No.: 873,457

[22] Filed: Apr. 24, 1992

[51] Int. Cl.[5] ..... E21B 33/10

[52] U.S. Cl. ..... 166/82; 166/118; 277/236

[58] Field of Search ..... 166/82, 118, 387; 277/233-236

[56] References Cited

U.S. PATENT DOCUMENTS

| | | | |
|---|---|---|---|
| 3,399,740 | 9/1968 | Barrington | 175/297 |
| 3,429,389 | 2/1969 | Barrington | 175/297 |
| 3,499,487 | 3/1970 | Barrington | 166/237 |
| 3,583,480 | 6/1971 | Regan | 166/82 X |
| 4,452,310 | 6/1984 | Pringle et al. | 166/319 |
| 4,467,870 | 8/1984 | Langham | 166/321 |
| 4,475,598 | 10/1984 | Brakhage, Jr. | 166/321 |
| 4,512,399 | 4/1985 | Gano et al. | 166/120 |
| 4,527,630 | 7/1985 | Pringle | 166/321 |
| 4,531,581 | 7/1985 | Pringle et al. | 166/120 |
| 4,582,134 | 4/1986 | Gano et al. | 166/120 |
| 4,583,596 | 4/1986 | Davis | 166/332 |
| 4,602,796 | 7/1986 | Setterberg | 277/236 |
| 4,691,780 | 9/1987 | Galle, Jr. et al. | 166/348 |
| 4,744,421 | 5/1988 | Wood et al. | 166/387 |
| 4,945,993 | 8/1990 | Dickson et al. | 166/321 |
| 4,960,172 | 10/1990 | Nelson | 166/208 |
| 5,044,672 | 9/1991 | Skeels et al. | 277/236 X |
| 5,067,734 | 11/1991 | Boehm, Jr. | 277/236 |
| 5,090,737 | 2/1992 | Brammer et al. | 166/82 X |
| 5,094,297 | 3/1992 | Bridges | 166/382 |
| 5,101,908 | 4/1992 | Mody | 166/387 |

*Primary Examiner*—Ramon S. Britts
*Assistant Examiner*—Frank S. Tsay
*Attorney, Agent, or Firm*—Dennis T. Griggs

[57] ABSTRACT

A straight bore metal-to-metal seal for connecting a tubing string to the mandrel of a well packer has a radially deflectable sealing member compressed between the internal bore surface of a tubular seal receptacle and the tubular body portion of a seal mandrel. The seal receptacle has a radially stepped sealing surface which is engaged by the deflectable sealing member in the operative sealing position. The inside bore of the deflectable sealing member is positively sealed against the outside surface of the seal mandrel by a pair of metal V-rings. A positive seal is also produced by engagement of the deflectable sealing member against the radially stepped bore of the seal receptacle. The deflectable sealing member is loaded by radial compression forces produced as a result of interference engagement of the deflectable sealing member against the radially stepped bore.

21 Claims, 2 Drawing Sheets

METAL-TO-METAL SEAL FOR OIL WELL TUBING STRING

FIELD OF THE INVENTION

This invention relates to well completion apparatus, and in particular to a straight bore metal-to-metal seal for connecting a tubing string to the mandrel of a well packer.

BACKGROUND OF THE INVENTION

Tubing seal assemblies are available for permanent and retrievable seal bore packers and are designed to be used as a seal between the tubing string and packer. J-slot and straight slot seal assemblies consist of three major components: a J-slot or straight slot locator body, molded or premium seal units, and a mule shoe guide. The purpose of such conventional seal assemblies is to provide a reliable, fluid tight seal between the production tubing string and the well packer production bore. Such units use premium elastomer seal elements which can be redressed in the field. However, the use of such elastomer seals is limited by downhole conditions such as high temperature, high pressure and corrosive fluids. Such elastomer seal elements are subject to degradation because of operation at elevated temperatures, chemical attack, thermal expansion, mechanical rupture when undergoing compression set. Moreover, such seals do not have repeatable seal performance when it becomes necessary to pull the tubing string and thereafter reestablish the sealed connection.

The use of premium elastomer seals is limited because of the hostile environment in some deep wells, for example, where the geopressure may exceed 20,000 psi and the temperature may exceed 400 degrees F. Corrosive fluids, including hydrogen sulfide and manganese chloride, affect elastomer and rubber seals. Moreover, corrosion inhibitors may be injected in the well to protect the tubing string, and such corrosion inhibitors are known to attack and have a corrosive effect on elastomer seal materials. Such deep, hostile environments are typical for subsea well completions. It will be appreciated that because of the corrosive conditions, it may be necessary to retrieve the seal assembly for redress, which is an expensive undertaking, especially for subsea well completions.

OBJECTS OF THE INVENTION

The general object of the present invention is to provide a metal-to-metal seal which will provide a positive seal under adverse pressure and temperature conditions.

A related object of the present invention is to provide a metal-to-metal seal for connecting a tubing string to a well packer which avoids the use of elastomer seals and which can be used in both high and low pressure and under high and low temperature conditions, and in the presence of corrosive fluids and gases.

Yet another object of the present invention is to provide a metal-to-metal seal of the character described which permits straight stabbing of the sealing elements into a straight bore without rotation.

Yet another object of the present invention is to provide a straight bore metal-to-metal seal which can be relocated and established over a variable area of the straight bore in a receptacle, and provide a positive seal upon each subsequent reconnection.

Still another object of the present invention is to provide a straight bore metal-to-metal seal assembly of the character described which can be set and retrieved without the use of special tooling.

SUMMARY OF THE INVENTION

The foregoing objects are achieved by a metal-to-metal seal assembly which includes a tubular seal sleeve having a radially deflectable, tubular sealing member compressed between the internal bore surface of a tubular seal receptacle and the tubular body portion of a seal mandrel. The inside bore of the tubular sealing member is sealed against the outside surface of the seal mandrel by a pair of metal V-rings. The seal receptacle has a radially stepped sealing surface which is engaged by the deflectable sealing member in the operative sealing position. The seal sleeve also includes a pair of internal collars which are separated by the deflectable sealing member. According to this arrangement, positive sealing engagement is produced at the interface of the metal V-rings against the seal mandrel and against the bore of the tubular sealing member, and also at the interface of the deflectable sealing member against the radially stepped bore of the seal receptacle when the seal sleeve is set in the operative sealing position. I the operative sealing position, the deflectable sealing member is loaded by radial compression forces produced as a result of the interference engagement of the deflectable sealing member against the radially stepped bore.

The novel features of the invention are set forth with particularity in the claims. The invention will best be understood from the following description when read with reference to the accompanying drawings.

DETAILED DESCRIPTION OF THE PREFERRED EMBODIMENT

Figure 1:
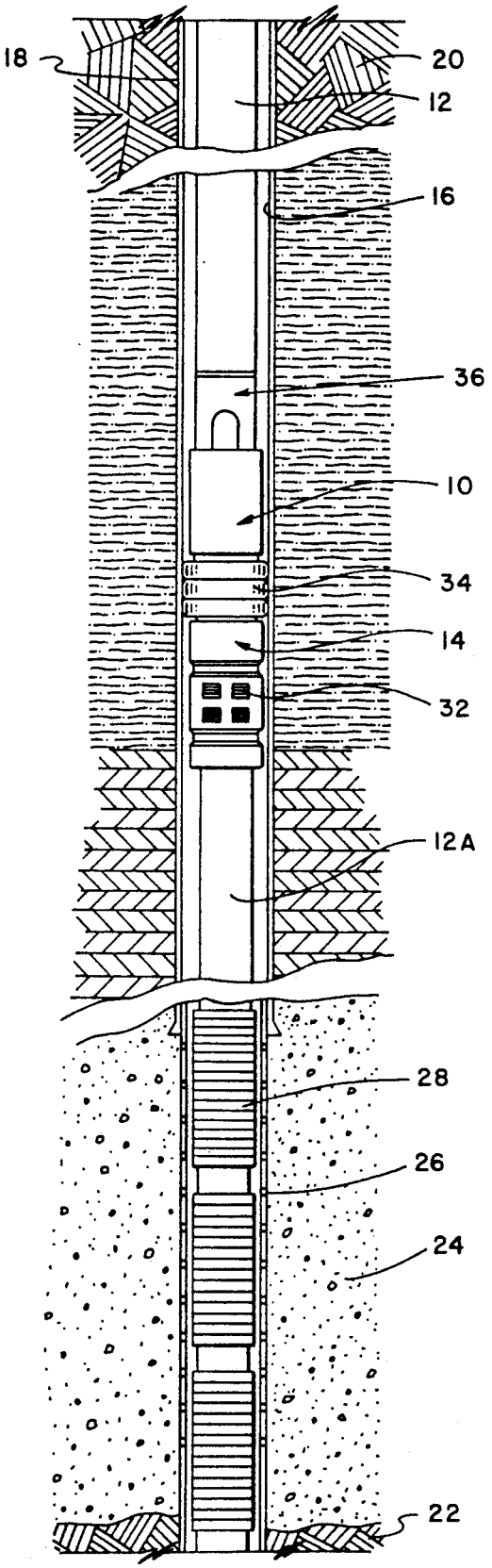
FIG. 1 is a simplified schematic diagram showing a production well intersecting a hydrocarbon producing formation with well completion apparatus, including a packer coupled to a production tubing string by a metal-to-metal seal assembly constructed according to the teachings of the present invention.

In the description which follows, like parts are marked throughout the specification and drawings with the same reference numerals, respectively. The drawings are not necessarily to scale and the proportions of certain parts have been exaggerated to better illustrate details and features of the invention.

Figure 2:
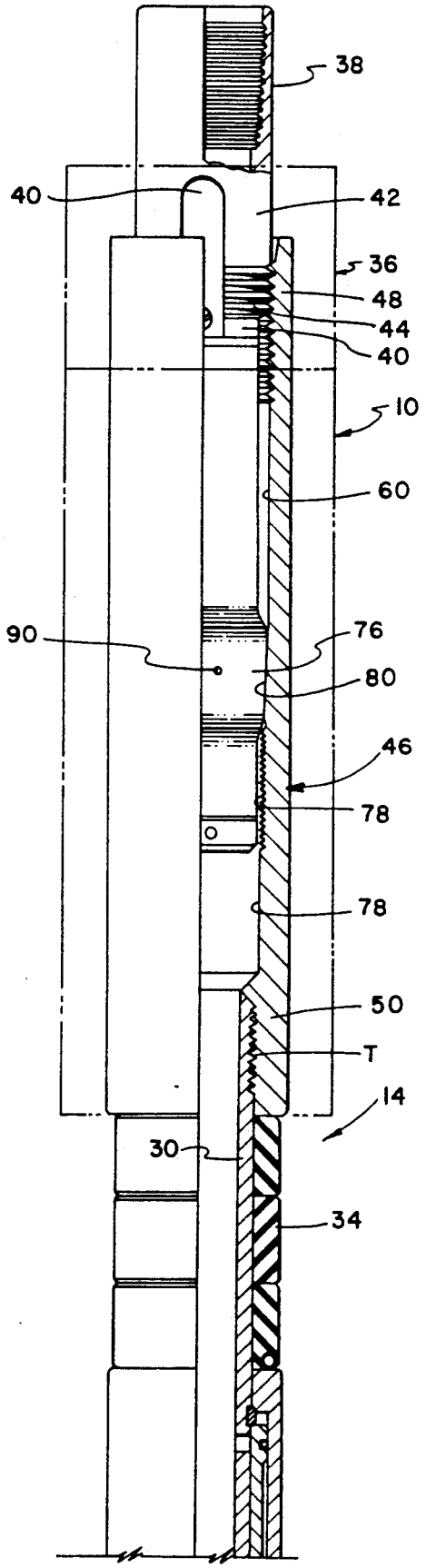
FIG. 2 is a longitudinal sectional view of a portion of the well packer and the metal-to-metal seal assembly in the unloaded (deenergized) position.

Referring now to FIGS. 1 and 2 of the drawings, a metal-to-metal seal assembly 10 is shown connecting the lower end of a production tubing string 12 to a retrievable, hydraulic set well packer 14. The packer 14 is shown in releasably set, sealed engagement against the bore 16 of a tubular well casing 18. The tubular well casing 18 extends through multiple layers of overburden 20, intersects multiple layers of underburden 22, then intersects a hydrocarbon formation 24. The tubular casing sections which intersect the hydrocarbon formation 24 are perforated by multiple flow openings 26. A well screen assembly 28 is suspended from the packer 14 on a length of production tubing 12A.

The packer 14 has a mandrel 30 on which anchor slips 32 and seal elements 34 are mounted. The anchor slips 32 are releasably set into engagement against the well casing 18, and the expanded seal elements 34 seal the lower casing annulus with respect to the upper casing annulus. The lower end of the production tubing string 12 is releasably coupled to the metal-to-metal seal 10 by a ratch latch assembly 36. The ratch latch assembly 36 includes a threaded box fitting 38 for makeup connection with a threaded pin connection (not shown) on the lower end of the production tubing 12. The ratch latch assembly 36 has a tubular mandrel 40 on which deflectable latch arms 42 are mounted. The deflectable latch arms 40 have radially projecting, annular ribs 44 which are adapted for interlocking engagement with complementary ribs and grooves.

Figure 4:
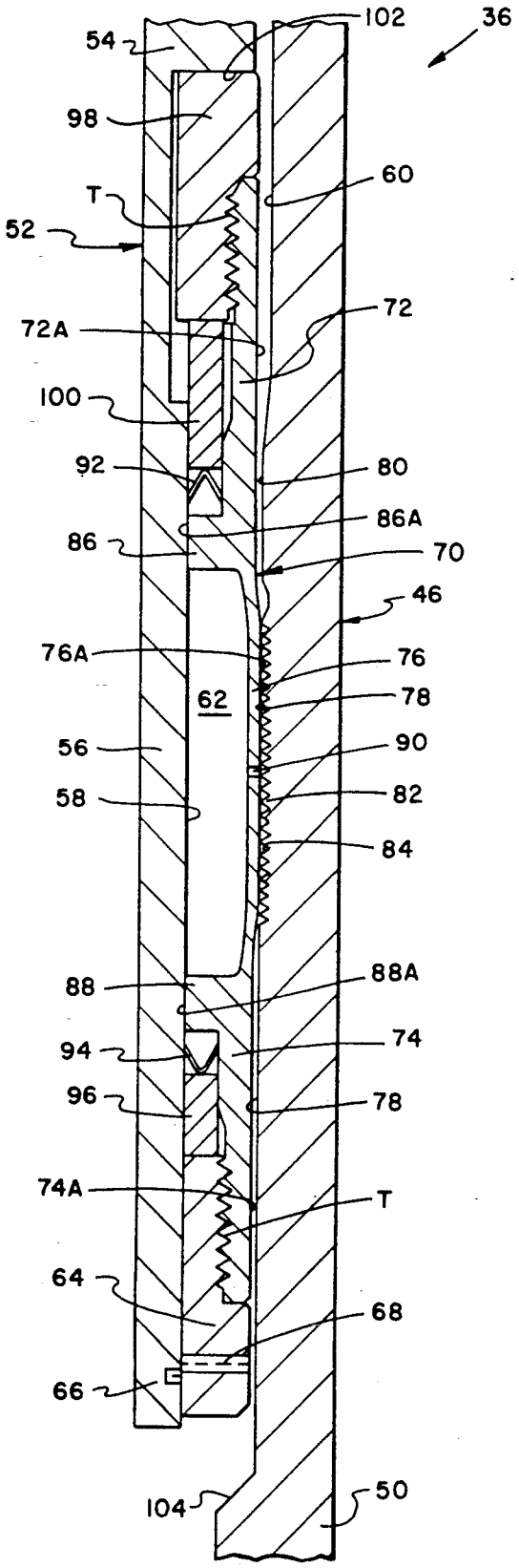

The metal-to-metal seal assembly 10 and ratch latch assembly 36 are preferably preassembled to the tubing string 12 and packer 14, and are run into the well in the energized configuration as shown in FIG. 4. It will be appreciated that the ratch latch assembly 36 may be eliminated for some installations where the metal-to-metal seal assembly 10 is installed on a solid running thread. In either case, the metal-to-metal seal assembly is securely attached and fully energized on the surface, and is thereafter run in releasably attached to the ratch latch assembly 36, or secured directly in a threaded union with the production tubing.

As shown in FIG. 2, the metal-to-metal seal assembly 10 includes a tubular seal receptacle 46 which has a first end portion 48 which is fitted with internal ribs and grooves disposed in releasable interlocking engagement with the deflectable latch arms 42 of the ratch latch assembly 36. The lower end 50 of the seal receptacle 46 is fitted with internal threads for making up a threaded union T with the upper end of the packer mandrel 30.

The metal-to-metal seal assembly 10 includes a tubular seal mandrel 52 which is attached on its upper end 54 to the latch mandrel 40. The seal mandrel 52 has an elongated tubular sidewall body portion 56 and a smooth external cylindrical surface 58. According to this arrangement, the seal mandrel 52 is suspended from the latch mandrel 40 in radially spaced relation with respect to the seal receptacle internal bore surface 60, thereby defining an annular seal chamber 62. The radially spaced position of the seal mandrel 52 is maintained by a lower retainer collar 64 which is mounted on the lower end 66 of the seal mandrel, and is secured to the seal mandrel 52 by a shear pin 68.

Figure 3:
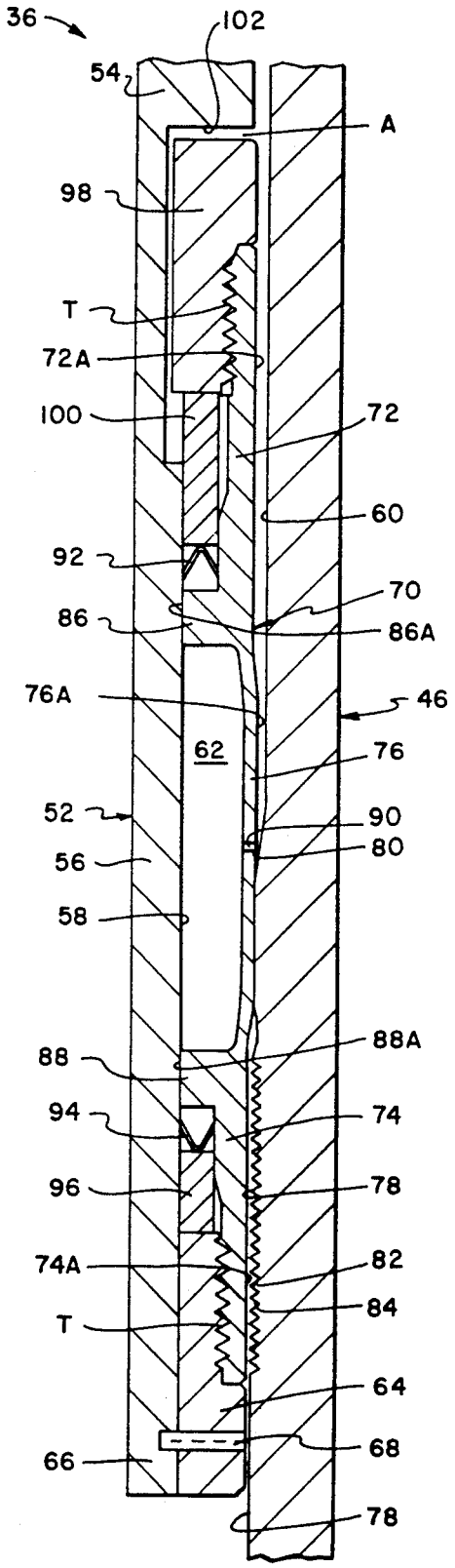
FIG. 3 is a sectional view showing the relative positions of the principal components of the metal-to-metal seal of FIGURE i in the deenergized position; and, FIG. 4 is a view similar to FIG. 3 which shows the relative positions of the metal-to-metal seal components in the energized position.

Referring now to FIG. 2, FIG. 3 and FIG. 4, positive sealing engagement is provided by a tubular seal sleeve 70 which is secured to the lower retainer collar 64 by a threaded union T. In the preferred embodiment, the seal sleeve 70 has an upper end portion 72, a lower end portion 74 and a radially deflectable, thin-walled sealing member 76 disposed between the external surface 58 of the seal mandrel body 56 and the internal bore 60 of the seal receptacle 46. The radially deflectable sealing member 76 is centered between the first and second seal sleeve end portions 72, 74, and is radially offset with respect to the first and second end portions. That is, in the unloaded (deenergized) condition as shown in FIG. 2 and FIG. 3, the deflectable seal member 76 is slightly convex and is bowed outwardly with respect to the first and second end portions 72, 74. In the relaxed, deenergized condition, the deflectable seal member has a slightly greater outside diameter along its sealing surface 76A as compared with the corresponding outside diameter surfaces 72A and 74A of the upper and lower end portions of the seal sleeve 70.

The seal receptacle 46 has a radially stepped internal bore, with the upper bore surface 60 having a slightly greater inside diameter as compared with the radially stepped bore surface 78. The internal bore transitions from the larger diameter bore 60 to the relatively smaller diameter stepped bore 78 along a tapered ramp surface 80. According to this arrangement, the seal sleeve 70 and deflectable seal member 76 are confined between the external surface 58 of the seal mandrel 56 and the internal bore surfaces 60, 78 and 80 of the seal receptacle 46. Since the seal element 70 is secured to the seal mandrel body 56 by the shear pin 68, it is carried along in extension and retraction as the seal mandrel 56 is extended or retracted by longitudinal extension and retraction of the latch mandrel 40.

During secondary runs, the inserted position of the latch mandrel 40 is adjusted to position the deflectable seal member 76 on the tapered ramp surface 80, as shown in FIG. 2 and FIG. 3. After the anchor slips and seal elements of the packer have been set against the well bore, the seal sleeve 70 is energized by applying a weight set down force through the tubing string on the latch assembly 76. The deflectable arms 42 and the latch ribs 44 are driven downwardly as the set down weight is applied until the deflectable seal member 76 is engaged against the stepped bore 78.

The sealing engagement is enhanced, according to one aspect of the invention, by an array of non-helical, annular ribs 82 which are formed on the radially stepped bore 78 by intersecting the bore surface with an array of annular grooves 84. It will be appreciated that the radially stepped bore surface 78 can be formed over a relatively long bore section of the tubular seal receptacle 46 so that repeatable sealing engagement can be obtained without precisely locating the deflectable sealing member 76 at a specific sealing point. The purpose of the non-helical ribs 82 is to increase the contact stress above the media pressure so that a positive seal can be produced. In the energized position as shown in FIG. 4, only the raised outside diameter 76A of the deflectable seal sleeve contacts the non-helical ribs 82.

Referring to FIG. 4, in the fully loaded set position, the deflectable sealing member 76 is deflected radially inwardly by engagement against the radially stepped bore surface 78. The force of sealing engagement is transmitted through the deflectable sealing member 76 and through first and second internal annular collars 86, 88 which are formed on the first and second seal sleeve end portions 72, 74, respectively. The radially deflectable seal member 76 is centered between the internal annular collars 86, 88 which maintain the radially deflectable sealing member in radially offset relation with respect to the external surface of the seal mandrel 52.

As can best be seen in FIG. 3, in the unloaded (deenergized) condition, the deflectable sealing member 76 has a convex curvature, and its external sealing surface 76A has an outside diameter which is greater than the outside diameter of the corresponding sealing surfaces of the upper and lower seal sleeve end portions 72, 74. Additionally, the deflectable seal member 76 is intersected by a small diameter bore 90 which provides for equalization of pressure on both sides of the deflectable seal member, thereby preventing deformation, collapse and/or burst damage caused by differential pressure conditions.

The collars 86, 88 have cylindrical bore surfaces 86A, 88A, respectively. The cylindrical bore surfaces 86A, 88A are slidably engaged against the external surface 58 of the seal mandrel 52. The seal sleeve 70 is sealed against the seal mandrel 52 by static metal V-rings 92, 94 which are compressed between the seal sleeve and the external surface 58 of the seal mandrel. The V-rings 92, 94 are confined radially between the seal mandrel and the upper and lower tubular end portions 72, 74 of the seal sleeve. The lower V-ring 94 is confined longitudinally by the lower collar 88 and by a spacer ring 96. The spacer ring is confined between the lower retainer collar 64 and the lower standoff collar 88. The upper end portion 72 of the seal sleeve is fitted with an upper retainer collar 98 which is joined to the upper end portion 72 by a threaded union T. The upper V-ring 92 is confined radially against displacement by the seal mandrel 52 and the upper end portion 72 of the seal sleeve. The upper V-ring 92 is confined longitudinally between the upper standoff collar 88 and a spacer ring 100. According to this arrangement, the seal assembly provides three separate areas of positive sealing engagement.

The shear pins 68 will shear apart when the seal mandrel 52 is stabbed into the seal receptacle 46. As the seal mandrel 52 is inserted within the receptacle bore, the deflectable seal member 76 rides in engagement against the tapered bore 80, and rides up onto the radially stepped bore 84, with its external sealing surface 76A being compressed in line engagement against the ribs 82. As this occurs, the upper retainer collar 98 is driven into engagement against a radial shoulder portion 102 which is formed in the upper end 54 of the seal mandrel 52. When the deflectable seal member 76 is unloaded (relaxed) as shown in FIG. 3, there exists a small longitudinal clearance A between the upper retainer collar 98 and the shoulder surface 102. However, as the deflectable seal member engages the sealing ribs 84, the lower end 66 of the seal mandrel 52 is displaced downwardly by a corresponding longitudinal distance A as the shoulder 102 is driven into engagement with the upper retainer collar 98.

The seal sleeve 70 is not permitted to move relative to the seal receptacle because of the high frictional engagement between the seal member 70 and ribs 82. The frictional engagement between the deflectable seal member 76 and the non-helical ribs 82 thus produce multiple lines of intensified, positive sealing engagement between the seal receptacle and the deflectable seal member 70. The shear pins will shear apart when the metal-to-metal seal assembly is stabbed-in to allow for interlocking movement in the latch assembly 36. Downward travel of the seal mandrel 52 relative to the seal receptacle 46 is limited by interlocking engagement of the latch assembly 36. If a releasable latch assembly is not utilized, downward travel of the seal mandrel 52 relative to the seal receptacle 46 is limited by engagement of the lower retainer collar 64 against an internal shoulder 104 formed on the lower end 50 of the seal receptacle 46.

The metal-to-metal seal 10 may be released and can be retrieved from engagement with the seal receptacle 46 by first releasing the latch 36, and then applying a straight upward pull on the tubing string 12 The latch assembly 36 is designed to be released by a clockwise one-third turn of the latch mandrel 40 relative to the seal receptacle 46, and then applying a straight upward pull. Upon separation of the shear pins 68, the deflectable seal member is retrieved from engagement with the non-helical ribs, and the inner components of the metal-to-metal seal assembly 10 are retrieved to the surface. The seal receptacle remains attached to the packer mandrel 30.

During secondary runs, a metal-to-metal seal is produced as a part of the initial set down before the latch 36 is fully engaged. By the time the latch is fully engaged, the metal-to-metal seal has been moved into the operative position (FIG. 4) and is fully energized, and the no-go indicator at the surface indicates that a latched union has been achieved. The loading of the deflectable seal element 76 is achieved simultaneously with latch completion.

The seal sleeve 70 is maintained in an energized state because the latch 36 effectively transfers the loading imposed by the upper production tubing string 12 through the latch receptacle 46 to the packer mandrel 30. The loading is transferred from the packer mandrel through the anchor slips 32 to the well casing 18. Accordingly, after the seal sleeve 70 has been energized, it remains in the energized state until the latch mandrel 40 is released and retracted.

The metal-to-metal seal components are preferably constructed of a flow-wetted corrosion resistant alloy (CRA) metal, for example, INCOLOY 925.

Although the invention has been described with reference to a preferred embodiment and with reference to a specific well completion, the foregoing description is not intended to be construed in a limiting sense. Various modifications of the preferred embodiment as well as alternative applications of the invention will be suggested to persons skilled in the art by the foregoing specification and illustrations. It is therefore contemplated that the appended claims will cover any such modifications, applications or alternative embodiments as fall within the true scope of the invention.

What is claimed is:

1. A metal-to-metal seal assembly for connecting a tubing string to a well packer comprising, in combination:

a tubular seal receptacle having a first end portion adapted for coupling attachment to a tubing string, a second end portion adapted for coupling attachment to a packer mandrel, and having an internal bore sealing surface for engaging a sealing member;

a tubular seal mandrel disposed within the tubular seal receptacle in radially spaced relation with respect to said internal bore surface thereby defining an annular seal chamber, said tubular seal mandrel having a tubular body portion disposed for engagement with a tubular seal sleeve; and, a tubular seal sleeve mounted on said seal mandrel and movable to an operative sealing position relative to the internal bore sealing surface of said seal receptacle, said tubular seal sleeve having a radially deflectable sealing member disposed within the annular seal chamber, said sealing member being compressed between the internal bore surface of the tubular seal receptacle and the tubular body portion of the seal mandrel in the operative sealing position.

2. A metal-to-metal seal assembly as defined in claim 1, including a seal ring confined under compression between the internal bore surface of said tubular seal receptacle and the external sealing surface of said seal mandrel.

3. A metal-to-metal seal assembly as defined in claim 1, wherein:

said tubular seal sleeve having a first end portion secured to said seal mandrel and a second end portion engaging the body portion of said seal mandrel, said radially deflectable sealing member being disposed between the first and second seal sleeve end portions and said deflectable sealing member being of said seal sleeve.

4. A metal-to-metal seal assembly as defined in claim 1, including:

a latch assembly including a tubular latch mandrel having a first end portion adapted for attachment to a tubing string and having a second end portion attached to said seal mandrel, and having a releasable latch member disposed in interlocking engagement with s id tubular seal receptacle.

5. A metal-to-metal seal assembly as defined in claim 1, including a first annular retainer releasably mounted on said seal mandrel and attached to said tubular seal sleeve.

6. A metal-to-metal seal assembly as defined in claim 1, said seal mandrel having a radially projecting shoulder disposed for engagement by said seal sleeve, said shoulder limiting longitudinal displacement of said seal sleeve.

7. A metal-to-metal seal assembly as defined in claim 1, wherein:

said seal sleeve having first and second end portions and first and second internal collars formed on said first and second seal sleeve end portions, respectively, said radially deflectable sealing member being disposed intermediate the first and second seal sleeve end portions, said first and second collars being mounted on the tubular body of said seal mandrel and maintaining the radially deflectable sealing member in radially offset relation with respect to the tubular body portion of said seal mandrel.

8. A metal-to-metal seal assembly as defined in claim 7, including first and second seal rings confined under compression between the external surface of said seal mandrel and the internal bore surface of said first and second seal sleeve end portions, respectively.

9. A metal-to-metal seal assembly as defined in claim 1, wherein the internal bore sealing surface of the tubular seal receptacle has a first internal bore surface and a second internal bore surface which is radially stepped with respect to the first internal bore surface, and including a tapered bore surface providing a transition ramp surface from the first bore surface to the radially stepped second bore surface.

10. A metal-to-metal seal assembly as defined in claim 1, wherein the internal bore sealing surface engaged by the deflectable sealing member in the operative position is intersected by an array of annular grooves, thereby defining a plurality of annular ribs separated by said annular grooves.

11. A metal-to-metal seal assembly for connecting a first tubular member to a second tubular member comprising, in combination:

a tubular seal receptacle having an internal bore surface for engaging a sealing member, said seal receptacle having a first end portion adapted for coupling attachment to the first tubular member and having a tubular end portion disposed for engagement with the second tubular member;

a tubular seal mandrel disposed within the tubular seal receptacle in radially spaced relation with respect to the internal bore surface thereby defining an annular seal chamber; and, a tubular seal sleeve disposed in the annular seal chamber, said tubular seal sleeve having a radially deflectable sealing member confined between the internal bore surface of the tubular seal receptacle and the tubular body portion of the seal mandrel.

12. Well completion apparatus comprising, in combination:

a well packer having a tubular mandrel, anchor slips and seal elements mounted on the packer mandrel for engaging the internal bore surface of a well casing;

a latch assembly including a tubular latch mandrel having a first end portion adapted for attachment to a tubing string and having a second end portion adapted for attachment to a seal mandrel, and having a releasable latch member disposed for interlocking engagement with a tubular seal receptacle; and, a metal-to-metal seal assembly including a tubular seal receptacle having a first end portion disposed in interlocking engagement with the releasable latch member and having a second end portion secured to the packer mandrel, a tubular seal mandrel disposed within the tubular seal receptacle, and a tubular seal sleeve disposed intermediate the seal mandrel and seal receptacle, said seal sleeve having a radially deflectable sealing member between the tubular seal receptacle and the seal mandrel.

13. A metal-to-metal seal assembly for connecting a tubing string to a well packer comprising, in combination:

a latch assembly including a tubular latch mandrel having a first end portion adapted for attachment to a tubing string and having a second end portion adapted for attachment to a seal mandrel, and having a releasable latch member disposed for interlocking engagement with a tubular seal receptacle;

a tubular seal receptacle having a first end portion disposed in interlocking engagement with the releasable latch member, a second end portion adapted for coupling attachment to a packer mandrel, and having an internal bore sealing surface for engaging a sealing member;

a tubular seal mandrel disposed within the tubular seal receptacle, said tubular seal mandrel having a first end portion secured to the tubular latch mandrel and having a tubular body portion disposed for engagement with a tubular seal sleeve; and, a tubular seal sleeve mounted on said seal mandrel, said tubular seal sleeve having a radially deflectable sealing member confined between the internal bore surface of the tubular seal receptacle and the tubular body portion of the seal mandrel 14. A metal-to-metal seal assembly for connecting a first tubular member to a second tubular member comprising, in combination:

a tubular seal receptacle having a first end portion adapted for coupling attachment to the first tubular member, a second end portion adapted for coupling attachment to the second tubular member, and having an internal bore sealing surface for engaging a sealing member, said internal bore sealing surface being characterized by a first bore sealing surface and a second bore sealing surface which is radially stepped with respect to the first sealing bore surface, and including a lead-in ramp surface interconnecting the first and second bore sealing surfaces;

a tubular seal mandrel supported within the tubular seal receptacle in radially spaced relation with respect to the internal bore sealing surfaces, said tubular seal mandrel having a tubular body portion disposed for engagement with a tubular seal sleeve; and, a tubular seal sleeve attached to said seal mandrel, said tubular seal sleeve having a radially deflectable sealing member disposed between the radially stepped bore surface of the tubular seal receptacle and the tubular body portion of the seal mandrel.

15. A metal-to-metal seal assembly as defined in claim 14, including an annular seal ring compressively confined between the inside bore surface of said tubular sleeve and the external surface of said seal mandrel.

16. A metal-to-metal seal assembly as defined in claim 14, wherein:

said tubular seal sleeve having a first end portion secured to said seal mandrel, a second end portion engaging the body portion of said seal mandrel, and said radially deflectable sealing member being disposed between the first and second seal sleeve end portions, said deflectable sealing member being radially offset with respect to the first and second seal sleeve end portions.

17. A metal-to-metal seal assembly as defined in claim 14, said tubular seal sleeve having first and second end portions and first and second internal collars formed on said first and second seal sleeve end portions, respectively, said first and second internal collars each having a cylindrical sealing surface engaging the tubular body portion of the seal mandrel and being joined together by said radially deflectable sealing member, said first and second internal collars maintaining said deflectable sealing member in radially offset relation with respect to said seal mandrel.

18. A metal-to-metal seal assembly as defined in claim 14, wherein:

said tubular seal sleeve having a first end portion secured to said seal mandrel, a second end portion supported between the tubular body portion of the seal mandrel and the internal bore of the tubular seal receptacle, first and second internal collars formed on the first and second end portions, respectively, said first and second collars engaging the seal mandrel, and the deflectable sealing member interconnecting the first and second end portions, said deflectable sealing member being supported in offset radially spaced relation with respect to the seal mandrel, said deflectable sealing member comprising a relatively thin, tubular sidewall which is radially offset with respect to the first and second end portions.

19. A metal-to-metal seal assembly as defined in claim 18, including first and second annular seals compressively confined between the external surface of said seal mandrel and the internal bore surfaces of the first and second end portions of said tubular seal sleeve.

20. A metal-to-metal seal assembly for connecting a first tubular member to a second tubular member comprising, in combination:

a tubular seal receptacle having an internal sealing bore surface for engaging a sealing member, said seal receptacle having a first end portion adapted for coupling attachment to the first tubular member and having a tubular end portion disposed for engagement with the second tubular member;

a tubular seal mandrel disposed within the tubular seal receptacle in radially spaced relation with respect to the internal bore surface thereby defining an annular seal chamber;

a tubular seal sleeve disposed in the annular seal chamber, said tubular seal sleeve having a radially deflectable sealing member confined between the internal bore surface of the tubular seal receptacle and the tubular body portion of the seal mandrel; and, an annular seal ring compressively confined in sealing engagement between the internal bore surface of the tubular seal sleeve and the external surface of said seal mandrel.

21. A metal-to-metal seal assembly as defined in claim 20, wherein said annular seal ring is a metal V-ring.

* * * * *